US005836745A

United States Patent [19]

Brogan et al.

[11] Patent Number: 5,836,745

[45] Date of Patent: Nov. 17, 1998

[54] FLUID RECOVERY APPARATUS AND METHOD USING A MOTIVE FORCE

[75] Inventors: David K. Brogan, Rindge; John R. Couture, Marlborough, both of N.H.; Michael M. Gifford, Rochester, Mass.

[73] Assignee: Sippican, Inc., Marion, Mass.

[21] Appl. No.: 571,082

[22] Filed: Dec. 12, 1995

[51] Int. Cl.[6] ..... F04B 5/48

[52] U.S. Cl. ..... 417/40; 417/54; 417/76; 417/87; 417/182.5

[58] Field of Search ..... 417/76, 87, 89, 417/182.5, 40, 54

[56] References Cited

U.S. PATENT DOCUMENTS

| | | | |
|---|---|---|---|
| 938,078 | 10/1909 | Roed . | |
| 1,618,337 | 2/1927 | Hoffman | 417/76 |
| 1,786,056 | 12/1930 | Durdin . | |
| 2,019,968 | 11/1935 | Holloway | 417/87 X |
| 2,080,624 | 5/1937 | McMahon . | |
| 2,879,144 | 3/1959 | Thornton . | |
| 3,963,376 | 6/1976 | Miskin | 417/89 X |
| 4,348,158 | 9/1982 | Wood | 417/40 |
| 4,482,299 | 11/1984 | Eulass | 417/54 |
| 4,501,659 | 2/1985 | Henk | 210/169 |
| 4,624,626 | 11/1986 | Sherfinski et al. | 417/87 |
| 4,818,389 | 4/1989 | Tobias et al. | 210/169 |
| 5,128,052 | 7/1992 | Bullock | 210/808 |

*Primary Examiner*—Richard E. Gluck
*Attorney, Agent, or Firm*—Testa, Hurwitz & Thibeault, LLP

[57] ABSTRACT

An apparatus for recovering fluid from a liquid formation includes a submersible pump for pumping fluid from the liquid formation. The submersible pump is coupled to an eductor defining a fluid member for receiving and transporting the fluid from the pump, and a fluid inlet in fluid communication with the fluid member for placement at a liquid-product layer in the formation. A probe assembly is coupled to the eductor for ensuring that the pump is inoperative when the fluid level in the formation is low. In operation, a motive force created by the upward flow of fluid pumped through the fluid member draws additional fluid into the fluid inlet from the liquid-product layer. The fluid entering the fluid inlet merges with the fluid flowing through the fluid member and is transported to a treatment facility. The recovery apparatus can further include an external fluid member coupled from the pump for receiving a portion of the fluid recovered by the pump and diverting it away from the eductor to the treatment facility.

22 Claims, 4 Drawing Sheets

FLUID RECOVERY APPARATUS AND METHOD USING A MOTIVE FORCE

FIELD OF THE INVENTION

This invention relates to recovery of fluids from a liquid formation, and more particularly to an apparatus and method for recovering fluids from a water formation using a motive force.

BACKGROUND OF THE INVENTION

Recovery of fluid from a water formation, such as a well or lake, has often been accomplished with the use of a recovery system. Conventional recovery systems employ pumps that pump fluid through fluid lines to a treatment facility outside of the water formation. Unfortunately, the fluid recovery rate of conventional recovery systems is often low, typically about 5 gallons per minute (GPM). This low recovery rate is generally attributable to pump clogging caused by the passage of heavy products through the pump. Gravity also plays a role in the low fluid recovery rate, as many recovery systems are inefficient or inoperative in pumping fluids from certain depths in a water formation to a treatment facility.

In an effort to increase the fluid recovery rate, some recovery systems employ additional pumps located at different levels in the water formation. These recovery systems are generally referred to as multi-stage recovery systems. Unfortunately, however, the use of additional pumps increases the cost and complexity of these systems, while generally not significantly increasing the fluid recovery rate or alleviating the problems previously described.

When hazardous or explosive fluids are present in water formations, special pumps (e.g., magnetically coupled or pneumatically driven pumps) that do not generate potentially igniting sparks typically are used. Electric pumps generally are not used to pump explosive or hazardous fluids because of the danger of explosion when such fluids pass through the pump.

SUMMARY OF THE INVENTION

It is an object of the invention to recover fluid from a liquid formation using a motive force.

It is another object of the invention to increase the rate of recovery of fluid from a liquid formation.

It is yet another object of the invention to reduce the amount of fluid passing through the pump of a recovery apparatus.

It is yet another object of the invention to reduce or eliminate the amount of hazardous or explosive fluid passing directly through the pump of a recovery apparatus.

The present invention relates to an apparatus and method for recovering fluid from a liquid formation using a motive force. The term liquid, as referred to herein, can include any one of a number of liquids, such as water. The term fluid, as referred to herein, can include any one of a number of liquids (e.g., water) and products found in a liquid formation. Because the invention has been found to be particularly useful for recovering water and products found in a water formation, the apparatus and method described in the specification generally refer to water and products as the "fluid" and a water formation as the "liquid formation." However, other fluids and liquids are within the spirit and scope of the invention.

In one embodiment of the invention, a recovery apparatus for recovering fluid from a water formation includes a submersible pump for pumping fluid from the water formation. The submersible pump is coupled to an eductor. The eductor has a bottom portion coupled to the pump and a top portion for coupling to a treatment facility via a fluid line. The eductor generally comprises a fluid member having a venturi disposed therein and a fluid inlet. The fluid member receives and transports the fluid from the pump. The fluid inlet is in fluid communication with the fluid member and is disposed at a water-product layer in the water formation. A motive force created by the upward flow of fluid pumped through the fluid member causes additional fluid to be drawn into the fluid inlet from at or near the water surface or water-product layer. The fluid entering the fluid inlet mixes with the fluid flowing through the fluid member and is transported to a treatment facility.

The use of a motive force to draw fluid and products into the fluid inlet prevents fluid containing a high concentration of product from traveling through the pump. As a result, the pump is less likely to become clogged with viscous product, the explosive or hazardous fluid is prevented from passing through the pump where sparks could present a danger, and the total fluid recovery rate attainable by the recovery apparatus increases.

In another embodiment of the invention, a recovery apparatus includes an external fluid member coupled to the pump and disposed in parallel with the eductor. As such, a portion of the fluid recovered by the pump is transported through the fluid member of the eductor to the treatment facility. The remaining portion of the fluid does not pass through the eductor and is transported from the pump through the external member to the treatment facility.

Additional aspects of the invention include a probe assembly for ensuring the safe operation of the pump within the water formation. More particularly, the probe assembly includes a float sensor and a low override sensor for communicating with a control unit to activate the pump when the water-product level rises above the fluid inlet, and to deactivate the pump when the water level in the water formation drops below a certain level.

The invention further relates to a method of receiving fluid from a liquid formation (e.g., a water formation). A pump is coupled to an eductor having a fluid member and a fluid inlet and is submerged into the liquid formation. The fluid inlet is positioned at a liquid-product layer (e.g., water-product layer) in the formation. Fluid from the liquid formation is pumped through the pump and is transported through the fluid member. A motive force is created as the fluid is transported that draws fluid from the liquid-product layer into the fluid inlet. The fluid from the fluid member is transported to a treatment facility.

In another embodiment of the method of the present invention, an external fluid member may be coupled to the pump. A portion of the fluid from the pump is transported through the external member, bypassing the eductor, to the treatment facility. The remaining fluid is transported through the eductor as described above.

The foregoing and other objects, aspects, features, and advantages of the invention will become more apparent from the following description, drawings, and claims.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the invention.

DESCRIPTION

Figure 1:
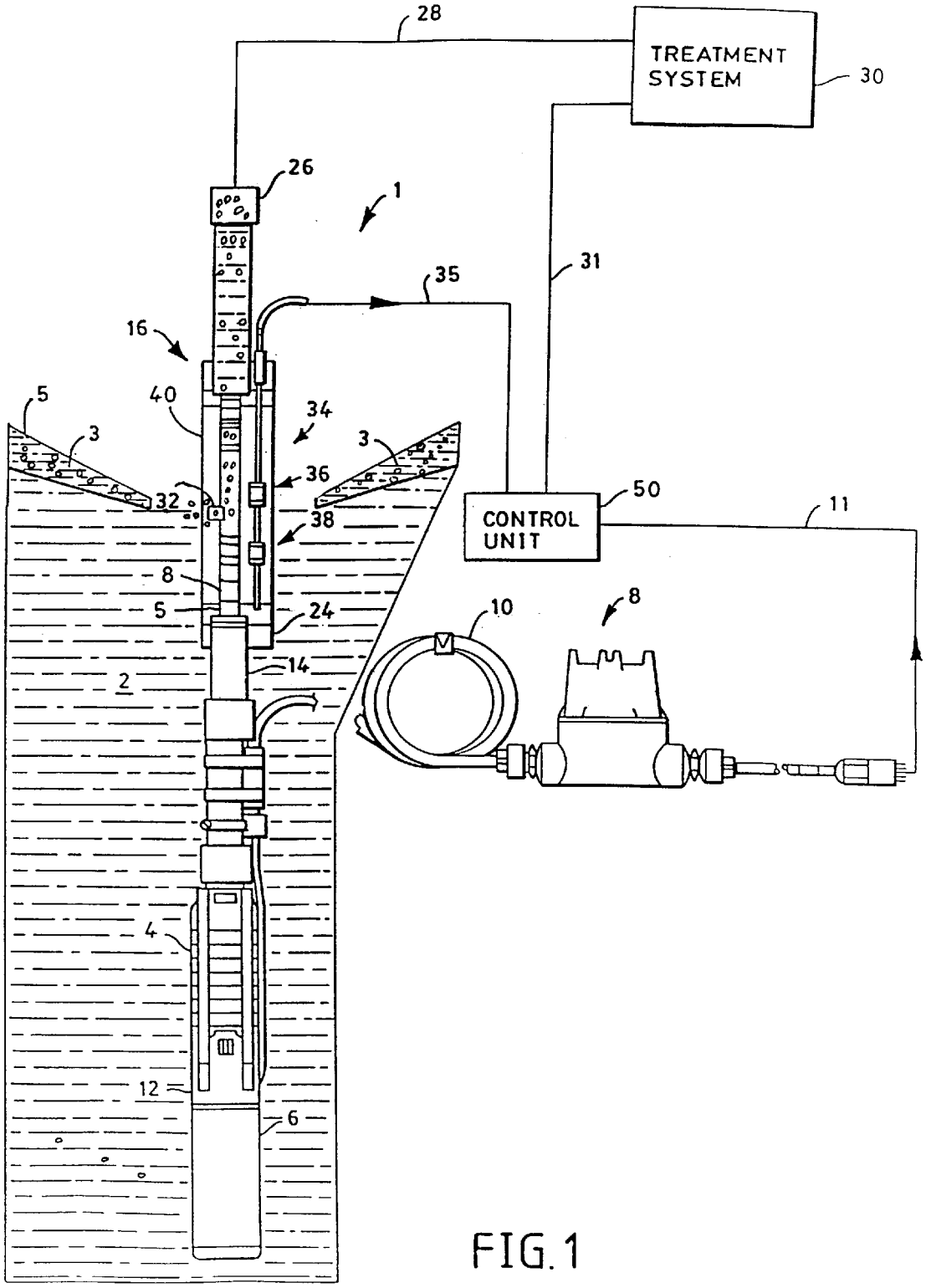
FIG. 1 is a longitudinal section of one embodiment of the recovery apparatus of the invention in a water formation.

Referring to FIG. 1, a recovery apparatus 1 includes a water table depressible pump 4 capable of being submerged in a water formation 2 such as a well or lake, for recovery of water and products from the water formation 2. Products found in the water formation 2 typically comprise explosive, non-explosive, water soluble, and/or water insoluble contaminants. The pump 4 can be, for example, an electric, hydraulic, pneumatic, or magnetically-coupled, single-stage or multi-stage pump, having a recovery rate within the range of about 3 to 80 gallons per minute (GPM). In the preferred embodiment, the pump 4 is an electric pump.

A submersible electric motor 6 connected to the pump 4, enables the pump 4 to operate within the above range of recovery rates. A pump start box 8 is coupled to the motor 6 via electrical wiring 10, and to a control unit 50, via wiring or a remote communication link 11. Alternatively, the pump start box 8 can reside within the control unit 50. The control unit 50 is located outside of the water formation 2, affording access to operating personnel. The pump start box 8 supplies power to the motor 6, which in turn, energizes the pump 4 for continuous operation until the pump start box 8 is deactivated. The control unit 50 is capable of activating the pump 4 in the event of a high fluid level in the water formation, and deactivating the pump start box 8 in the event of a low fluid level in the water formation, as further described below.

A fluid intake port 12 located at one end of the pump 4 is adapted, in use, to reside below a surface 5 of the water formation 2 to ensure that typically product-free water passes through the pump. At the other end of the pump, a fluid outlet 14 is adapted, in use, to face the surface 5 of the water formation 2. The fluid outlet 14 is coupled to a bottom portion 24 of an eductor 16 via a coupler 15 such that fluid recovered by the pump 4 is transported to the eductor 16. The eductor 16 generally comprises a fluid member 18, such as fluid-tight pipe that is approximately 6 to 7 inches in length. The length of the fluid member 18 can vary depending on fluid recovery requirements. The top portion of the eductor 16, referred to as the total fluids output 26, is in fluid communication with a treatment facility 30 via a fluid line 28, typically comprising piping or tubing.

The treatment facility 30 typically performs filtration, purification, or removal processes for extracting products from the effluent of the total fluids output 26. The treatment facility 30 can include such fluid processing devices as an oil/water separator and an air stripper (not shown). The treatment facility 30 can include other fluid processing devices capable of treating water and products depending on the degree and/or type of water purification desired. The treatment facility 30 is in electrical communication with the control unit 50 preferably via wiring or a remote communication link 31. The treatment facility 30 is capable of transmitting signals to the control unit 50 related to desired operating conditions of the recovery apparatus 1.

A fluid inlet 32, emanating from the eductor 16 between the bottom portion 24 and the total fluids output 26, is capable of recovering additional water and products from a water-product layer 3 or water from the surface 5 of the water formation 2. The fluid inlet 32 is in fluid communication with the fluid member 18 such that the water and products recovered by the fluid inlet 32 are transported to the treatment facility 30.

The water-product layer 3 is an area, typically near the top of the water formation 2, where groundwater interfaces with a high concentration of products. More specifically, this layer 3 is a layer of high product concentration. Alternatively, the water-product layer can be found near or at the bottom of the water formation. Regardless of the location of the water-product layer 3, the concentration of products in the layer 3 is considerably higher than the concentration of products located in the area of the pump's fluid intake port 12. The water-product layer 3 typically has a top surface where a high concentration of lighter products are commonly found, and a bottom surface where a high concentration of heavier products are commonly found. As will be further described below, the fluid inlet 32 is capable of sucking in water and products from the water-product layer 3, so that fluid having the highest concentration of products generally is drawn in only through the inlet 32 and does not travel through the pump 4.

It should be noted that, although it is not shown explicitly in the drawings for the sake of clarity, during operation the fluid inlet 32 is actually located in the layer 3. That is, the layer 3 actually surrounds and touches a screen 40 around the eductor 16. The layer 3 is not shown extending to the screen 40 for the sake of clarity. Also, the layer 3 is shown as a cone of depression around the screen. This is actually what happens to the layer 3 and the surface 5 of the water as the pump 4 is operating. The pumping action of the pump 4 causes this cone of depression to occur. As will be described in more detail hereinafter, a probe assembly 34 is employed to keep the fluid inlet 32 in, or substantially in, the layer 3 during operation.

The probe assembly 34 is a generally elongated member coupled to the eductor 16. The screen 40 surrounds the eductor 16 and probe assembly 34 to prevent the fluid inlet 32 and the probe assembly 34 from becoming clogged with heavy foreign matter (e.g., garbage, plant life) present in the water formation 2. The probe assembly 34 typically includes an inlet float sensor 36, a low override sensor 38, and electrical wiring 35 connecting the sensors 36, 38 to the control unit 50. The sensors 36, 38 are positioned to define the top and bottom of the desired water levels within which the pump can safely operate. The inlet float sensor 36 senses the fluid level in the water formation 2 to ensure that the recovery apparatus 1 is operative when the fluid level rises above the fluid inlet 32, and is not operative when the fluid level drops below the fluid inlet 32. The low override sensor 38, is a back-up sensor that deactivates the pump 4 in the event that the inlet float sensor 36 fails to sense a low water level in the water formation 2 and deactivate the pump 4. The low override sensor 38 also ensures that the submersible pump 4 is operational only when submerged in the water formation 2. In providing such assurances, the inlet float sensor 36 and the low override sensor 38 signal the control unit 50 to activate the pump 4 when the water level rises above the eductor 16, and deactivate the pump 4 when the water level in the water formation 2 falls below a predetermined level, as further described below.

Figure 2:
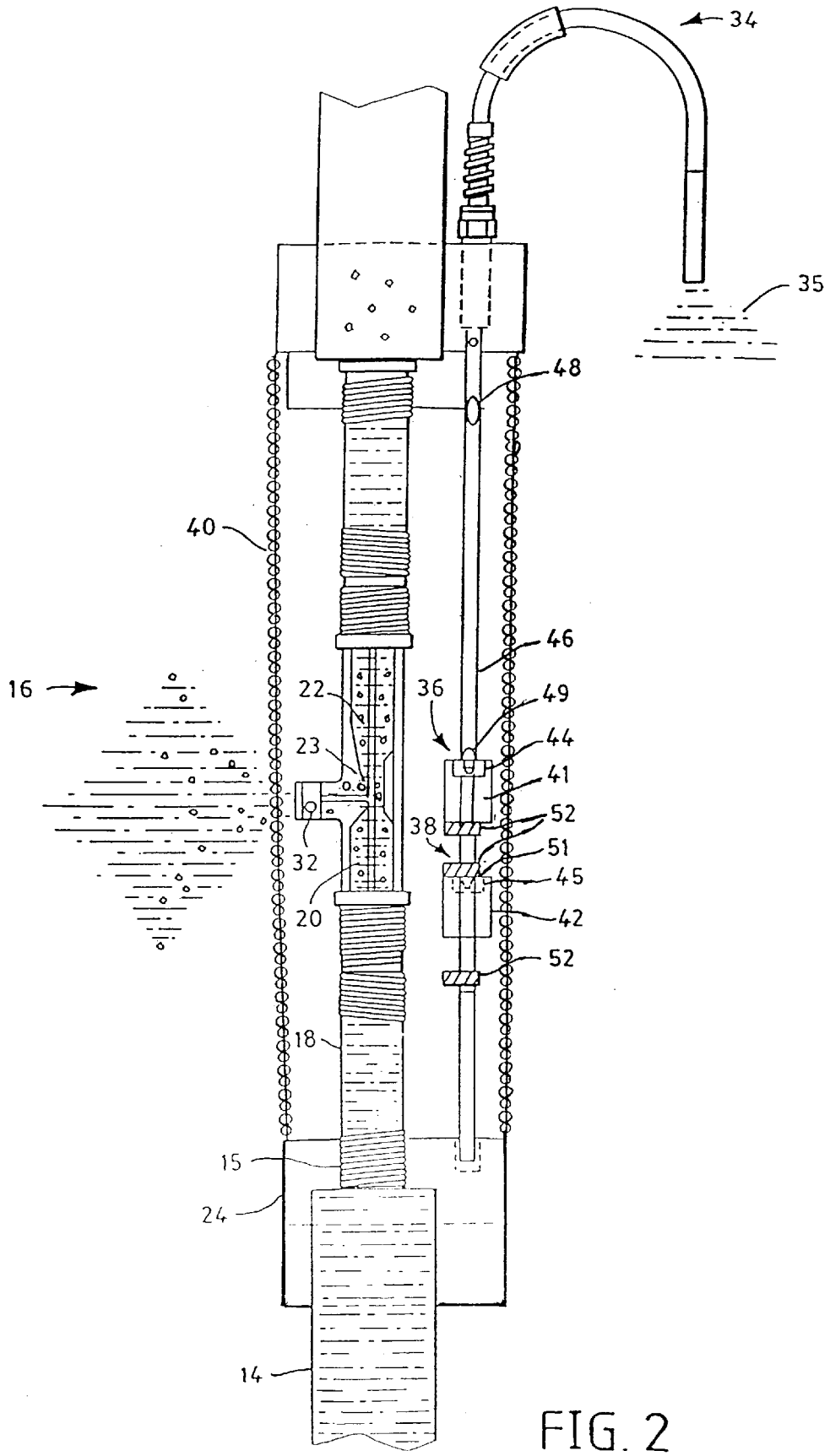
FIG. 2 is a partial longitudinal section of the recovery apparatus of the invention, illustrating the eductor and the probe assembly.

FIG. 2 shows a partial longitudinal section of the eductor 16 and probe assembly 34. A portion of the fluid member 18 is conically shaped to form a venturi 22, which serves to draw water and products from the water-product layer 3 in through the fluid inlet 32 and into the upward flow (i.e., "motive force") passing through the fluid member 18. In one embodiment, the fluid member 18 is about 2 inches in diameter except in the area of the venturi 22 where the diameter is about 1 inch. The venturi-area diameter and non-venturi-area diameter of the fluid member 18 can vary depending on fluid recovery requirements.

The fluid inlet 32 typically has a diameter that is smaller than the diameter of the fluid member 18, and this fluid inlet 32 diameter is, in some embodiments, about 0.25 inches to 0.5 inches. The diameter of the fluid inlet 32 can vary depending on fluid recovery requirements. The difference between the diameter of the fluid inlet 32 and the diameter(s) of the fluid member 18 aids in drawing water and products into the fluid inlet 32. In particular, the difference in diameter creates a pressure differential at a junction 23 of the fluid inlet 32 and the fluid member 18 that draws fluids into the fluid inlet 32 when fluid travels through the fluid member 18, as further described below.

The inlet float sensor 36 and low override sensor 38, respectively, comprise floats 41, 42 slidably disposed on a metal cylinder 46. The floats 41, 42 are typically fabricated of a buoyant material such as polyurethane foam and nylon. A magnetic member 44, 45 is disposed within the interior of each of the floats 41, 42. Magnetic reed switches 48, 49, 51 located within the interior of the metal cylinder 46, are magnetically activated by the magnetic members 44, 45 disposed within the floats 41, 42. In the embodiment disclosed in FIG. 2, three magnetic reed switches 48, 49, 51 are located within the interior of the metal cylinder 46, and two floats 41, 42 are slidably disposed on the surface of the metal cylinder 46. The number of magnetic reed switches 48, 49, 51 and floats 41, 42 employed in the probe assembly 34 can be modified depending on the degree of level sensitivity required.

The magnetic reed switches 48, 49, 51 and floats 41, 42 are located with respect to the metal cylinder 46 according to the desired water levels to be monitored. The magnetic reed switches 48, 49, 51 communicate with the control unit 50, which determines whether a change in state, (e.g. open or closed) has occurred. Typically, signals are transmitted from the magnetic reed switches 48, 49, 51 to the control unit 50 when the magnetic reed switches 48, 49, 51 change from a closed state to an open state. A pair of float stop collars 52 are also located on the metal cylinder 46, for limiting the distance that the floats 41, 42 can travel on the cylinder 46.

The magnetic reed switches 48, 49, 51 are in an open state in the absence of a magnetic field created by the magnetic members 44, 45 in the floats 41, 42. The magnetic reed switches 48, 49, 51 are in a closed state in the presence of a magnetic field created by the magnetic members 44, 45 within the floats 41, 42. The magnetic reed switches 48, 49, 51 are held closed by the magnetic field created by the magnetic members 44, 45 in the floats 41, 42. The control unit 50, upon sensing the closure of the top magnetic reed switch 48, activates the pump 4. The control unit 50, upon sensing the closure of the bottom magnetic reed switch 49 (or upon sensing the closure of the lower magnetic reed switch 51 if the other switch 49 does not close for some reason), deactivates the pump. The lower magnetic reed switch 51 is normally open, however in FIG. 2, it is shown held closed by the magnetic member 45 of the bottom float 42. The float stop collars 52, located along the metal cylinder 46 at the upper and lower extremities, limit the distance that the floats 41, 42 can travel and ensure proper placement of the floats 41, 42 relative to the magnetic reed switches 48, 49, 51.

Referring now to FIGS. 1 and 2, the control unit 50 is typically located outside of the water formation 2. The control unit 50 generally includes a programmable processor in electrical communication with the probe assembly 34, the pump 4, and the treatment facility 30. The control unit 50 continuously receives signals related to operation from the probe assembly 34, the pump 4, and the treatment facility 30. In response to such signals, the control unit 30 can initiate apparatus shutdown, subsequent re-activation, and notification of apparatus conditions to operating personnel. Parameters used by the control unit 50 in determining whether shutdown is required, (e.g. low and high water levels in a water formation, and voltage requirements) can be stored in a memory module which can be housed in the control unit 50 with the processor.

In operation, the fluid recovery apparatus 1 described with reference to FIGS. 1 and 2 is initially lowered into the water formation 2 by an operator or machine (e.g., winch) via, for example, chain(s) or rope(s). The recovery apparatus 1 is positioned such that the pump 4 is submerged, the fluid intake port 12 is below the water-product layer 3, the total fluids output 26 of the eductor 16 is disposed above the surface 5 of the water formation 2, and the fluid inlet 32 is disposed at or near the water surface 5 or the water-product layer 3. Upon activation of the pump start box 8, the motor 6 is energized causing the pump 4 to pump water and products from the bottom of the water formation 2 through the fluid member 18. Substantially all of the water and products drawn into the fluid intake port 12 are transported through the fluid member 18.

As water and products are transported, a motive force is created in the fluid member 18. The motive force creates a vacuum at the fluid inlet 32 that pulls water and products from the water-product layer 3 into the fluid inlet 32. The vacuum is further strengthened by a pressure differential at the junction 23 resulting from a negative pressure existing at the fluid inlet 32, and a positive pressure existing in the fluid member 18. The pressure differential is due, in part, to the diameter of the fluid member 18 being larger than the diameter of the fluid inlet 32. The pressure differential at the junction 23 draws fluid and products into the fluid inlet 32 with a significant force. This suction is generally known as a venturi effect.

As water and products are pulled into the fluid inlet 32, they are drawn into the fluid member 18 by the motive force of the water and products transported through the fluid member 18 from the pump 4. The suction of water and products through the fluid inlet 32 yields a high fluid recovery rate of water and products through the total fluids output 26. For example, when using a pump 4 having a recovery rate of 10 gallons per minute (GPM), water and products are recovered through the fluid member 18 at 10 GPM which causes a suction or pull of additional water and products through the fluid inlet 32 at approximately 0.5 GPM.

In general, water and products from the water-product layer 3 are sucked into the fluid inlet 32, and thus fluids with the highest concentration of products never pass through the pump 4. Thus, pump malfunction due to clogging (a common problem associated with conventional recovery systems) is unlikely to occur with the recovery apparatus 1 of the invention. In addition, with the invention, a commercially available electric high-output pump can be used in the recovery apparatus to recover fluids, even explosive or hazardous fluids, and bring them to the surface 5 for treatment. Any explosive or hazardous material, typically highest in concentration in the water-product layer 3, will be sucked into the fluid inlet 32 and will never pass through the pump 4 itself, and thus there will be no chance of an explosion due to a spark created by the electric pump 4. The invention thus eliminates the need to use special, non-sparking pumps (e.g., magnetically coupled pumps or pneumatically driven pumps), and it allows commercially available, more-reliable electric pumps to be used.

Upon recovering an amount of water and products, the fluid level within the water formation 2 decreases and the floats 41, 42 slide along the metal cylinder 46 between the float stop collars 52. Generally, as the floats 41, 42 slide down, the magnetic reed switches 49 and/or 51 sense a magnetic field created by the magnetic member in the float 41 and/or 42 and closes. A signal indicative of closure is transmitted to the control unit 50. In response to such closure, the control unit 50 subsequently deactivates the pump 4.

The control unit 50 receives and processes the signal(s) transmitted by the magnetic reed switch(es), and the control unit 50 in turn transmits a signal to the pump start box 8 causing deactivation of the pump start box 8 which in turn causes deactivation of the motor 6 and the pump 4. Upon deactivation, the water formation 2 may refill with water and products, as water and products are no longer being removed from the water formation 2. Alternatively, and more commonly, the water level in the well is now permanently lowered, and the recovery apparatus 1 according to the invention thus must now be lowered further into the well until the floats 41, 42 move again into a position where the pump is activated. As the water level rises or, alternatively, as the apparatus is lowered, the lower float 42 slides up along the metal cylinder 46 away from the lower magnetic reed switch 51 toward the top magnetic reed switch 48. The lower magnetic reed switch 51, upon sensing the absence of a magnetic member 45, returns to its normally open state. As the floats 41, 42 continue to slide upwardly along the metal cylinder 46, the top magnetic reed switch 48 senses the magnetic member 44, and transmits a signal indicative of closure to the control unit 50. The control unit 50 receives and processes the signal and transmits a signal to the pump start box 8 causing it to activate thus energizing the motor 6 and the pump 4. Upon reactivation, fluid recovery resumes.

The water and products recovered by the recovery apparatus 1 typically are sent via a fluid line 28 to the treatment facility 30 where fluid processing takes place. Products such as oil, silt, and other contaminants typically are separated from water at the treatment facility 30 such that purified water is ultimately obtained. During fluid processing, the treatment facility 30 communicates with the control unit 50.

Figure 3:
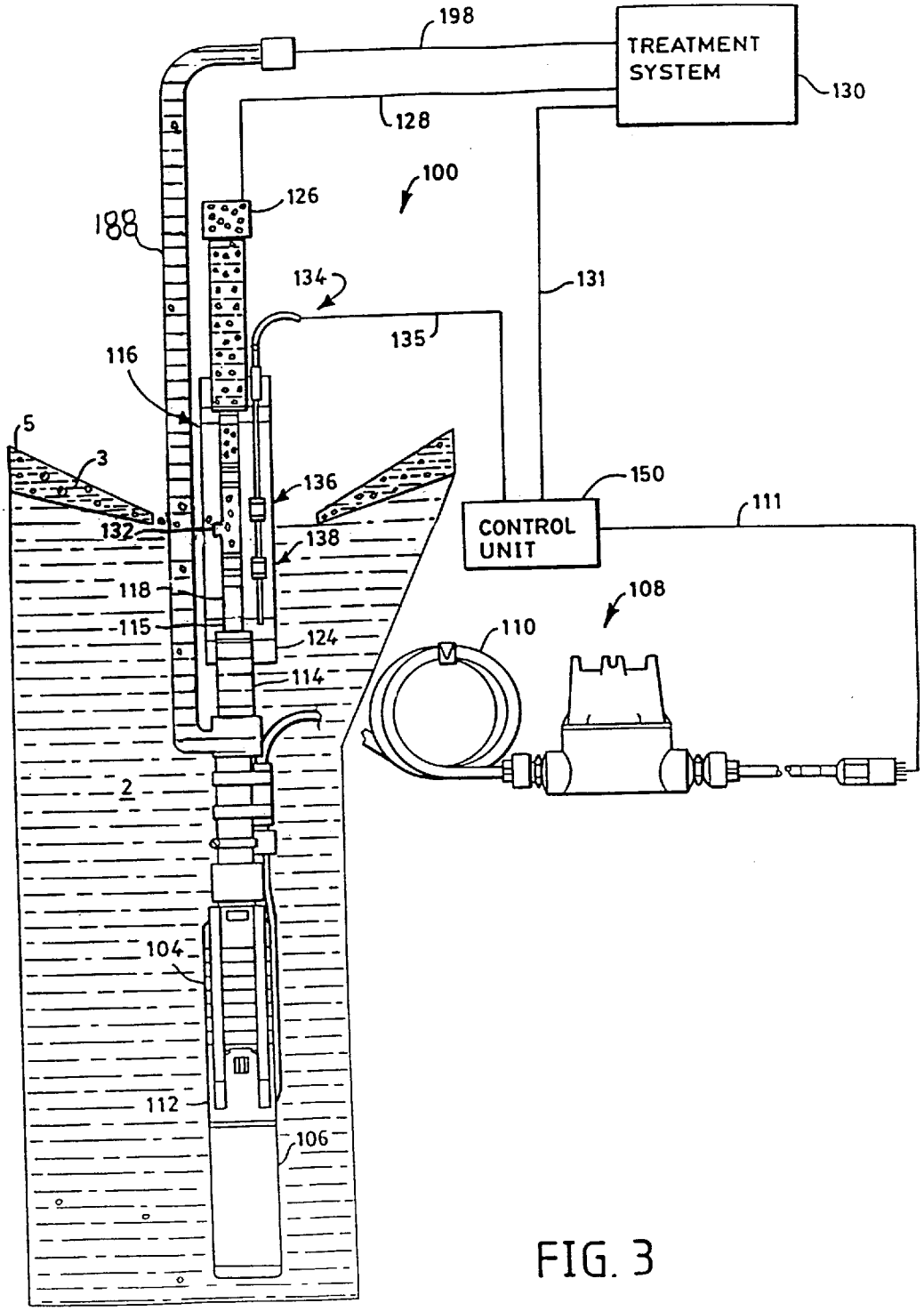
FIG. 3 is a longitudinal section of an alternative embodiment of the recovery apparatus of the invention.

In another embodiment of a recovery apparatus 100 according to the invention, as shown in FIG. 3, the recovery apparatus 100 includes a pump 104 having a fluid intake port 112 (adapted, in use, to reside below the surface 5 of the water formation 2) and a fluid outlet 114 (adapted, in use, to face the surface 5 of the water formation 2). A pump start box 108 is coupled via electrical wiring 110 to a motor 106, and it is coupled to a control unit 150 via electrical wiring or remote communication link 111. The fluid outlet 114 of the pump 104 is coupled to a bottom portion 124 of an eductor 116 via a fluid coupling 115. The eductor 116, as previously described in FIGS. 1 and 2, has a fluid inlet 132 and a probe assembly 134 which are surrounded by a screen 140. In most embodiments, the eductor 116 is in fluid communication with a treatment facility 130 via a fluid line 128. The probe assembly 134 has an inlet float sensor 136 and a low override sensor 138, both capable of delivering signals over electrical wiring 135 to the control unit 150, as described above. The control unit 150 further communicates with the treatment facility 130, preferably via a remote communication link 131.

An external fluid member 188 emanates from the fluid outlet 114 of the pump 104. The external fluid member 188 extends away from the pump and preferably runs parallel to the eductor 116. In the disclosed embodiment, the treatment facility 130 is in fluid communication with the external fluid member 188 via a fluid line 198 (e.g., piping or tubing). The external fluid member 188 is capable of receiving about, for example, half of the water and products recovered by the pump 104, with the portion (e.g., the remaining half) being pumped into a fluid member 118 of the eductor 116.

The fluid recovery apparatus 100 generally operates as described previously with reference to FIGS. 1 and 2, with a few differences. The recovery apparatus 100 is placed in the water formation 2 such that the pump 104 is submerged and the fluid intake port 112 resides below the surface 5 of the water formation 2. A total fluids output 126 of the eductor 116 is positioned above the surface 5 of the water formation 2, with the fluid inlet 132 located at the water-product layer 3. The pump 104, after initial powering, pumps water and products toward the fluid outlet 114. In the disclosed embodiment, about half of the water and products recovered by the pump 104 are diverted away from the eductor 116 through the external fluid member 188 and transported to, for example, the treatment facility 130 for processing. The remaining half of the water and products pump by the pump 104 are passed through the fluid member 118 of the eductor 116 (and then to the treatment facility 130). As the water and products are transported through the fluid member 118, a motive force is created that sucks water and products into the fluid inlet 132 from the water-products layer. The water and products join the water and products recovered by the pump 104 that are currently flowing up through the fluid member 118. This combined, or total, fluids flow is then transported out of the recovery apparatus to, for example, the treatment facility 130.

The apparatus of FIG. 3 yields a lower fluid recovery rate out of the total fluids output 126 than the embodiment of FIG. 1. This is because in FIG. 3 only a portion (e.g., about half) of the water and products recovered by the pump 104 are transported through the fluid member 118 of the eductor 116. As the motive force through the fluid member 118 is lessened, the strength of the suction at the fluid inlet 132 is of course reduced. The recovery apparatus of FIG. 3 can be particularly useful in a water formation where the concentration of products at the water-product layer is fairly low. In such a water formation, a relatively small motive force and therefore a small vacuum at the fluid inlet is sufficient to pull the water and products residing at the water-product layer into the fluid inlet.

Table 1 below shows the parameters of the recovery apparatus that yield specific fluid recovery rates out of the total fluids output when an eductor with a suction rating of 25 GPH is used. Such an eductor is commercially available from the Mazzei Injector Corporation as model number 584. As shown across the top of this table, the parameters include: well depth in feet; the recovery rate through the total fluid output in GPM or gallons per minute; the recovery rate through the fluid inlet in GPH or gallons per hour (i.e., the suction of the eductor); pump model number; and pump horsepower. The pumps are electric pumps commercially available from Grundfos Environmental Pumps. The total fluids output (26, 126), as discussed above, includes water and products taken in from the pump (4, 104) as well as water and products sucked into the fluid inlet (32, 132).

TABLE 1

Eductor Model No. 584

| WELL DEPTH (FEET) | RECOVERY RATE THROUGH TOTAL FLUIDS OUTPUT (GPM) | RECOVERY RATE THROUGH FLUID INLET (GPH) | PUMP MODEL NUMBER | PUMP HORSEPOWER |
|---|---|---|---|---|
| 11.4 | 4.3 | 25 | 5E3 | 1/3 |
| | 4.9 | 25 | 5E5 | 1/3 |
| 22.7 | 5.5 | 25 | 5E8 | 1/3 |
| 45.5 | 6.3 | 25 | 5E12 | 1/2 |
| 68.2 | 6.9 | 25 | 5E17 | 3/4 |
| | 7.2 | 25 | 10E8 | 1/2 |
| 34.1 | 6 | 25 | 10E5 | 1/3 |
| 113.6 | 8.1 | 25 | 10E11 | 3/4 |
| 136.4 | 9 | 25 | 10E14 | 1 |
| 181.8 | 10.4 | 25 | 10E19 | 1.5 |

As shown in Table 1, for a well depth of 11.4 feet, the recovery rate for fluids transported through the total fluids output is 4.3 GPM when a pump having model number 5E3 and a ⅓ horsepower rating is used. The recovery rate through the fluid inlet is 25 GPH. With different pump models having different horsepower ratings coupled to the model 584 eductor, different recovery rates through the total fluids output are possible and dependent on the well depth.

Table 2 below shows the parameters of the recovery apparatus that yield specific fluid recovery rates out of the total fluids output, when an eductor with a suction rating of 30 GPH is used. Such an eductor is commercially available from Mazzei Injector Corporation as model number 684. For a well depth of 11.4 feet, the recovery rate for fluids transported through the total fluids output is 5.5 GPM when a pump having model number 5E3 (available from Grundfos Environmental Pumps) having ⅓ horsepower is used.

TABLE 2

Eductor Model No. 684

| WELL DEPTH (FEET) | RECOVERY RATE THROUGH TOTAL FLUIDS OUTPUT (GPM) | RECOVERY RATE THROUGH FLUID INLET (GPH) | PUMP MODEL NUMBER | PUMP HORSE-POWER |
|---|---|---|---|---|
| 11.4 | 5.5 | 21.5 | 5E3 | 1/3 |
| 15.9 | 6.6 | 23 | 5E5 | 1/3 |
| 18.2 | 7 | 30 | 5E8 | 1/3 |
| 34.1 | 9.3 | 30 | 10E5 | 1/3 |
| 68.2 | 10.6 | 30 | 10E8 | 1/2 |
| 90.0 | 11.5 | 30 | 10E11 | 3/4 |
| 102.3 | 11.8 | 30 | 10E14 | 1 |
| 136.4 | 12.8 | 30 | 10E19 | 1.5 |

Table 3 below shows the parameters of the recovery apparatus that yield specific fluid recovery rates out of the total fluids output, when an eductor with a suction rating of 17 GPH is used. Such an eductor is commercially available from Mazzei Injector Corporation as model number 484. The various pump models are available from Grundfos Environmental Pumps.

TABLE 3

Eductor Model No. 484

| WELL DEPTH (FEET) | RECOVERY RATE THROUGH TOTAL FLUIDS OUTPUT (GPM) | RECOVERY RATE THROUGH FLUID INLET (GPH) | PUMP MODEL NUMBER | PUMP HORSE-POWER |
|---|---|---|---|---|
| 11.4 | 2.3 | 18 | 5E3 | 1/3 |
| 45.5 | 3.4 | 18 | 5E5 | 1/3 |
| 79.5 | 3.8 | 17 | 5E8 | 1/3 |
| 125.0 | 4.5 | 17 | 5E12 | 1/2 |
| 159.1 | 5.2 | 17 | 5E17 | 3/4 |
| 193.2 | 5.7 | 17 | 5E21 | 1 |
| 204.5 | 6 | 17 | 5E25 | 1.5 |
| | 6 | 17 | 10E14 | 1 |

Table 4 below shows the parameters of the recovery apparatus that yield specific fluid recovery rates out of the total fluids output, when an eductor with a suction rating of 10 GPH is used. The eductor is commercially available from Mazzei Injector Corporation as model number 384.

TABLE 4

Eductor Model No. 384

| WELL DEPTH (FEET) | RECOVERY RATE THROUGH TOTAL FLUIDS OUTPUT (GPM) | RECOVERY RATE THROUGH FLUID INLET (GPH) | PUMP MODEL NUMBER | PUMP HORSE-POWER |
|---|---|---|---|---|
| 79.5 | 2.4 | 10.3 | 5E8 | 1/3 |
| 159.1 | 3 | 10.5 | 5E12 | 1/2 |
| 204.5 | 3.5 | 10.5 | 5E17 | 3/4 |

Figure 4:
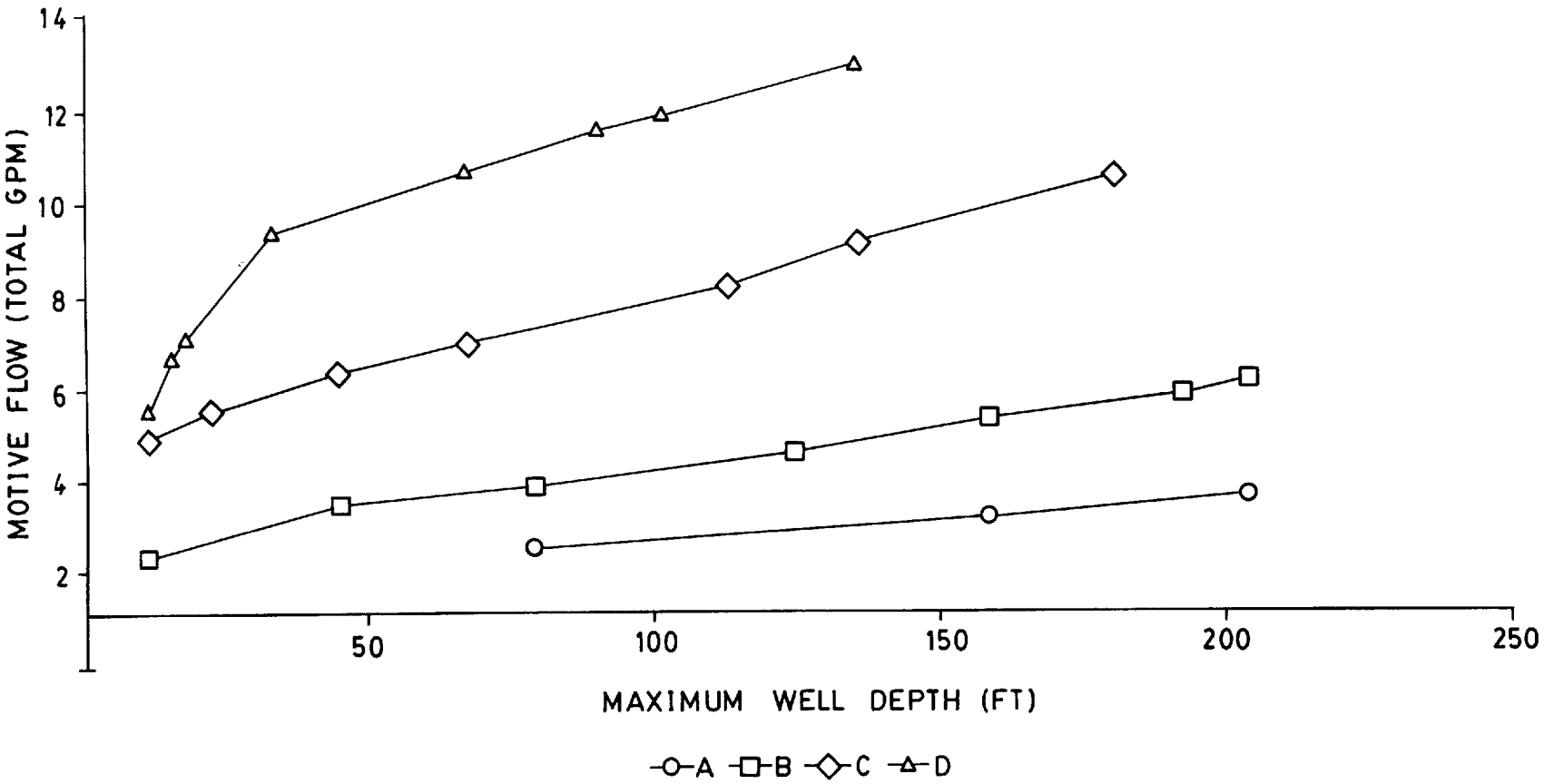
FIG. 4 is a graph of the output flow achieved by the recovery apparatus of the invention.

FIG. 4 is a graph of the fluid recovery rate out of the total fluids output achieved by the recovery apparatus of the invention at different well depths using the eductor/pump combinations described previously with reference to Tables 1–4. The well depth appears along the x axis in feet, and the fluid recovery rate out of the total fluids output appears along the y axis in GPM.

As shown on the lower curve on this graph, labeled A, a recovery rate through the total fluids output is about 2 to 3 GPM when the recovery rate through the inlet of the eductor is about 10 GPH. This corresponds to about 12 to 18 percent surface water recovery for a well having a depth in the range of up to approximately 200 feet. As expected, the total fluid output recovery rate increases with increasing pump sizes, ranging from about 5 to 25 percent surface water recovery.

The succeeding curve, labeled B, shows that a recovery rate through the total fluids output is about 2 to 5 GPM when the recovery rate through the inlet of eductor is about 17 GPH. This corresponds to about 7 to 17 percent surface water recovery for a well having a depth of up to approximately 200 feet. The next curve, labeled C, shows that a recovery rate through the total fluids output is about 5 to 10 GPM when a recovery rate through the fluid inlet of the eductor of about 25 GPH. This corresponds to about 12 to 24 percent surface water recovery for a well having a depth of up to approximately 180 feet. The top curve, labeled D, shows that a recovery rate through the total fluids output is about 6 to 12 GPM when a recovery rate through the inlet of the eductor is about 30 GPH. This corresponds to about 12 to 24 percent surface water recovery for a well having a depth of up to approximately 140 feet.

Variations, modifications, and other implementations of what is described herein will occur to those of ordinary skill in the art without departing from the spirit and the scope of the invention as claimed. Accordingly, the invention is to be defined not by the preceding illustrative description but instead by the following claims.

What is claimed is:

1. Apparatus for recovering fluid from a water formation having a water-product layer, comprising:

a submersible pump for pumping a fluid from the water formation;

an eductor comprising:

a bottom portion coupled to the pump;

a top portion for coupling to a treatment facility;

a fluid member having a venturi disposed therein, the fluid member extending from the bottom portion to the top portion for transporting the fluid from the pump to the top portion; and a fluid inlet in fluid communication with the fluid member and positionable at the water-product layer, such that the fluid transported through the fluid member creates a motive force causing additional fluid to be drawn into the fluid inlet from the water-product layer.

2. The apparatus of claim 1, wherein a diameter of the fluid inlet is smaller than a diameter of the fluid member, such that a pressure differential exists at a junction of the fluid inlet and the fluid member.

3. The apparatus of claim 1, further comprising a fluid coupling member connecting the bottom portion to the pump such that substantially all of the fluid pumped is transported through the fluid member.

4. The apparatus of claim 1, further comprising an external fluid member connected to the pump for transporting fluid from the pump to a treatment facility.

5. The apparatus of claim 1, further comprising:

a probe assembly coupled to the eductor; and a control unit in electrical communication with the probe assembly, disposed external to the water formation.

6. The apparatus of claim 5, wherein the probe assembly comprises a float sensor for sensing a level of fluid in the water formation.

7. The apparatus of claim 6, wherein the probe assembly further comprises a low override sensor for sensing a decrease in a level of fluid in the water formation when the float sensor is inactive.

8. The apparatus of claim 5, wherein the probe assembly comprises at least one float sensor comprising a buoyant material having a magnetic member embedded therein.

9. The apparatus of claim 8, wherein the probe assembly further comprises a metal cylinder slidably receiving the float sensor.

10. The apparatus of claim 9, wherein the probe assembly further comprises:

at least one magnetic reed switch disposed on the metal cylinder; and at least one float stop collar disposed on the metal cylinder.

11. The apparatus of claim 10, wherein the magnetic reed switch alternates from an open state to a closed state upon contact with the float sensor.

12. The apparatus of claim 11, wherein the magnetic reed switch is electrically coupled to the control unit for transmission of signals to the control unit indicative of a closed state or an open state.

13. The apparatus of claim 5, further comprising a screen surrounding the eductor and the probe assembly.

14. The apparatus of claim 1, wherein the fluid comprises water and products.

15. The apparatus of claim 14, wherein the products comprise contaminants.

16. The apparatus of claim 1, wherein the venturi is conically shaped.

17. Apparatus for recovering water and products from a water formation comprising:

a submersible pump for pumping water and products from the water formation;

a first fluid member in fluid communication with the pump for transporting water and products from the pump to a treatment facility;

an eductor fluid communication with the pump, comprising:

a second fluid member for receiving water and products from the pump; and a fluid inlet in fluid communication with the second fluid member, the fluid inlet having a smaller diameter than a diameter of the second fluid member, such that water and products pumped through the second fluid member create a vacuum at the fluid inlet, the vacuum pulling water and products from a water-product layer, into the fluid inlet.

18. The apparatus of claim 17, further comprising:

a probe assembly coupled to the eductor for ensuring that the pump is submerged within the water formation during operation.

19. A method of recovering water and products from a water formation comprising:

providing a pump coupled to an eductor, the eductor defining a fluid member, and a fluid inlet in fluid communication with the fluid member;

inserting the pump and the eductor into a water formation;

submerging the pump in the water formation;

locating the fluid inlet at a water-product layer in the water formation;

pumping water and products from the water formation through the fluid member;

transporting the water and products through the fluid member to create a motive force in the fluid member that pulls water and products from the water-product layer through the fluid inlet; and transporting the water and products from the fluid member to a treatment facility.

20. The method of claim 19, further comprising:

providing an external member emanating from the pump;

pumping water and products through the external member; and transporting the water and products from the external member to the treatment facility.

21. A method of recovering liquid and products from a liquid formation comprising:

submerging a pump, coupled to an eductor having a fluid member in fluid communication with a fluid inlet, into a liquid formation;

positioning the fluid inlet at a liquid-product layer in the liquid formation;

pumping liquid and products from the liquid formation through the fluid member;

transporting the liquid and products through the fluid member to create a motive force in the fluid member that draws liquid and products from the liquid-product layer through the fluid inlet into the fluid member; and transporting the liquid and products through the fluid member to a treatment facility.

22. The method of claim 21, wherein the liquid is water.

* * * * *